United States Patent [19]

Apen et al.

[11] 4,038,487

[45] July 26, 1977

[54] SHIELDED MULTIPAIR CABLE

[75] Inventors: John Robert Apen, Stone Mountain; William Homer Bray, Jr., Tucker, both of Ga.

[73] Assignee: Bell Telephone Laboratories, Incorporated, Murray Hill, N.J.

[21] Appl. No.: 673,411

[22] Filed: Apr. 5, 1976

[51] Int. Cl.[2] ..... H01B 7/18

[52] U.S. Cl. ..... 174/36; 174/105 B

[58] Field of Search ..... 174/36, 35 R, 23 R, 174/105 R, 105 B, 107, 102 R

[56] References Cited

U.S. PATENT DOCUMENTS

| | | | |
|---|---|---|---|
| 3,622,683 | 11/1971 | Roberts et al. | 174/36 |
| 3,803,340 | 4/1974 | Jachimowicz et al. | 174/36 |
| 3,881,052 | 4/1975 | Britz et al. | 174/36 X |
| 3,911,200 | 10/1975 | Simons | 174/36 |
| 3,968,321 | 7/1976 | Olszewski | 174/36 |

*Primary Examiner*—Arthur T. Grimley

*Attorney, Agent, or Firm*—Charles E. Graves

[57] ABSTRACT

A cable screen for multipair communication cables is formed in the general shape of an H with the cross member being expandable by the application of gas pressure. The expansion process also aids in reducing the size of air pockets in any viscous cable fill present; and also creates a permanent duct within the core for supplying gas pressure to points along the cable route.

7 Claims, 7 Drawing Figures

SHIELDED MULTIPAIR CABLE

FIELD OF THE INVENTION

This invention relates to multipair communication cables and more particularly to the reduction of near-end cross talk and related improvements in such cables.

BACKGROUND OF THE INVENTION

It has long been recognized that near-end cross talk (NEXT) between two signals transmitted at substantially the same high fequency in opposite directions over different pairs in the same communication cable, is not overcome merely by the use of differing pair twists for the transmitting pairs. Accordingly, in recent years, metallic screens have been used to promote further electrical isolation between one or more groups of conductors and other groups within the cable core. In a screened cable, many pairs of separate transmission paths for oppositely traveling signals of like frequency can be selected. The high energy amplified signal leaving a repeater, for example, is impeded by the screen from propagating into a pair carrying relatively weak, incoming signals.

Most screened cables currently in use, however, manifest a small but still significant coupling between certain pairs on opposite sides of the screen. A number of different mechanisms are responsible, including the transfer surface impedance of the screening material, and coupling around the screen.

Moreover, the addition of screens complicates somewhat the cable manufacturing process, especially for cables with petroleum jelly-filled cores. Partly due to the screen's presence, the jelly does not flow freely after introduction, resulting in occasional air pockets forming within the core.

SUMMARY OF THE INVENTION

In its broadest aspect, this invention resides in a commmunications cable screen configured as two metallic sheets, each originally having the cross section of a straightback "C" and located within the cable core in back-to-back relation to each other. The composite screen resembles the letter H, and for convenience will hereafter be so called. When desirable, electrical isolation between the two sections of the H-screen is enhanced by a polyethylene separating sheet which can, for example, be laminated to one or both of the sections.

The H-screen construction provides highly effective isolation of pairs on its opposite sides. In an extension of the basic invention, the H-screen is constructed to provide additional advantages unrelated to electrical isolation.

Specifically, the two C-sections are bonded together along two parallel separated regions on either side of the screen's center axis, affording an unbonded zone between these two regions. After the cable is installed in the outside plant, a gas pressure applied between the two sections at one end of the unbonded region will cause an expansion or ballooning sufficient to form a gas flow corridor along the core axis, defined by the two sections of the H-screen within the bonded regions. Once formed, the corridor can be used to supply continuous gas pressure to repeater cases, for example, which otherwise would require a separate source of gas pressure.

If the cable is a filled core type, expansion of the H-screen provides the further benefit of displacing the filling jelly, forcing it more fully into the core and, in the process, breaking up any air pockets present.

DETAILED DESCRIPTION

Figure 1:
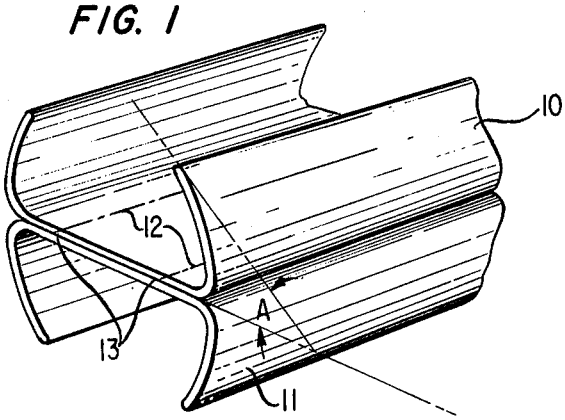
FIGS. 1, 2, 3 and 4 are schematic perspective diagrams of the H-screen in stages of manufacture and use.

FIG. 1 shows schematically two aluminum tapes 10, 11, each formed with a relatively flat base and each having tow oppositely diverging sides or wings contoured to a cable jacket's inner surface. The wrap-around of each side may vary, but advantageously is about 45° as defined by the angle A of FIG. 1.

Figure 2:
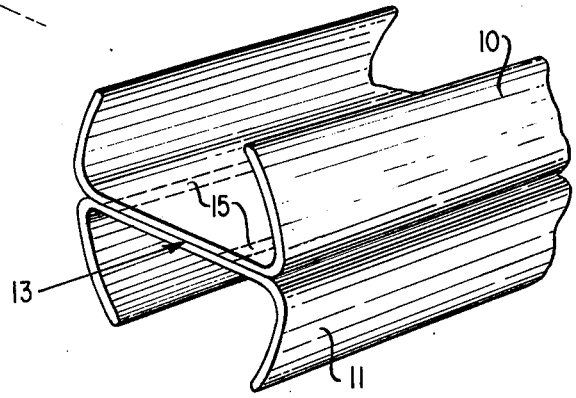
Figure 3:
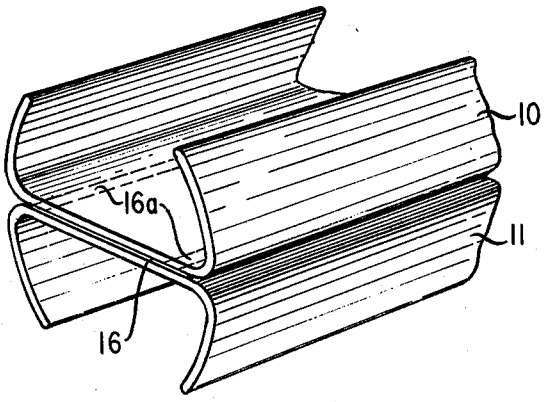
Figure 4:
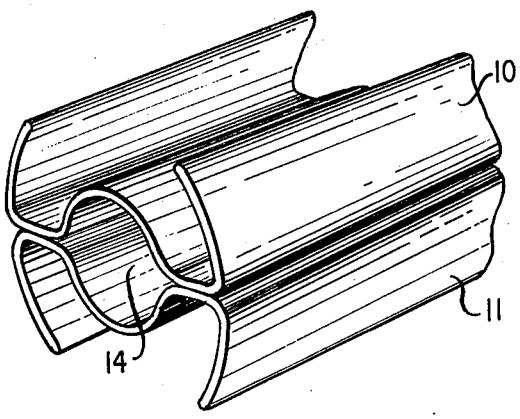

The metallic backs of the two shield sections 10, 11 may be in direct contact with each other as in FIG. 1, and joined, as for example, by welding along the separated lines denoted 12. A continuous gas-tight weld makes possible the inflating of the region denoted 13 between the weld lines to create the chamber 14 of FIG. 4. An alternate means of fastening the two shield sections 10, 11 is by an adhesive bonding along the two parallel separated bonding regions 15 seen in FIG. 2. The bonding material can be, for example, an ethylene-acrylic acid copolymer. The region 13 of this structure likewise may be expanded by pressurized gas. A further means of joining sections 10, 11 shown in FIG. 3 is by inclusion therebetween of a plastic sheet 16 having self-adhesive properties, or adhesive applied, in the parallel separate regions **16*a*** on both sides.

The use of two aluminum tapes 10, 11 adds considerable electrical isolation strength to the structure which is advantageous for high-frequency systems, such as Tl and TlC telephone carriers operating at 1 MHz and above. Metal-to-metal contact between the layers 10, 11, shown in FIG. 1, simplifies production and has the further electrical advantage of affording double metallic thickness to reduce NEXT for pairs in close proximity. A further reduction of NEXT can be afforded by electrically insulating the shield portions 10, 11 from one another. In such case, a sheet 16 made of, for example, polyethylene is interposed between the two shield sections.

Figure 7:
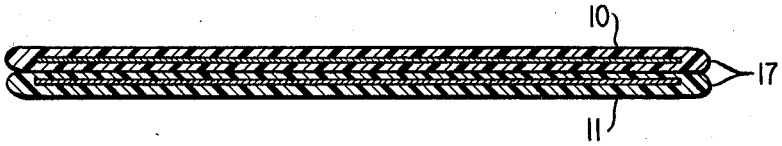
FIG. 7 is a schematic end view of exemplary stock for making H-screens.

An alternate starting material for forming shield sections is depicted in FIG. 7 as consisting in its unformed state of two flat aluminum tapes 10, 11 laminated completely within an insulating material 17, such as polyethylene.

Figure 5:
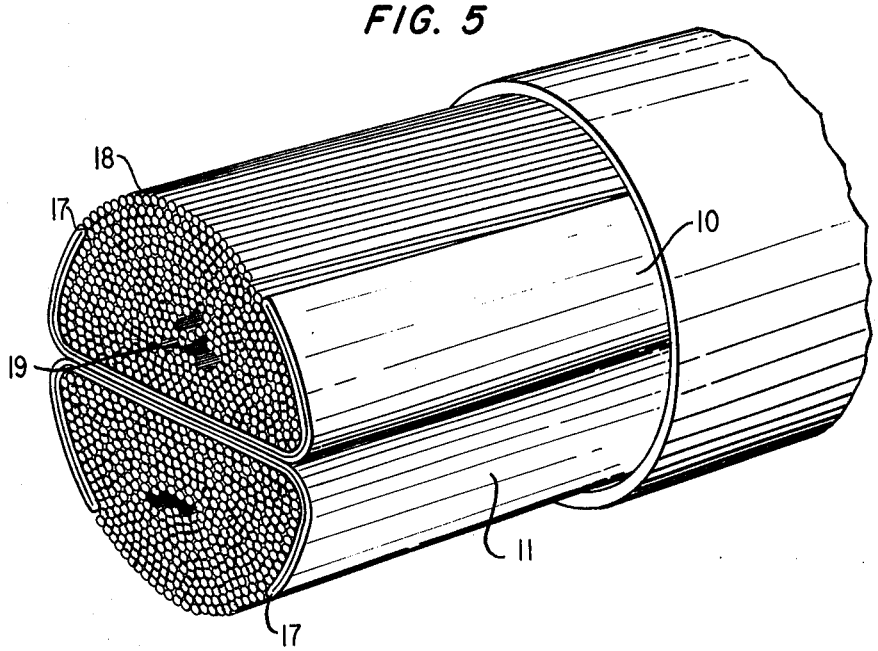
FIG. 5 is a schematic sectional view of a cable containing H-screen.

A cable shield made up of the sheet material of FIG. 7 is shown in FIG. 5 installed in the unexpanded state separating conductor pairs 18 of two conductor groups located on opposite sides of the shield. Petroleum jelly envelops most of the conductor pairs 18, except in the area of an exemplary void 19 within the core structure. Expansion of the region 13 will hydraulically force fill material into the void 19 and substantially eliminate or at least break up the void 19. In the ballooning process, the basic configuration of the conductor and the shield is maintained by the enveloping pressures of the jacket 20.

Figure 6:
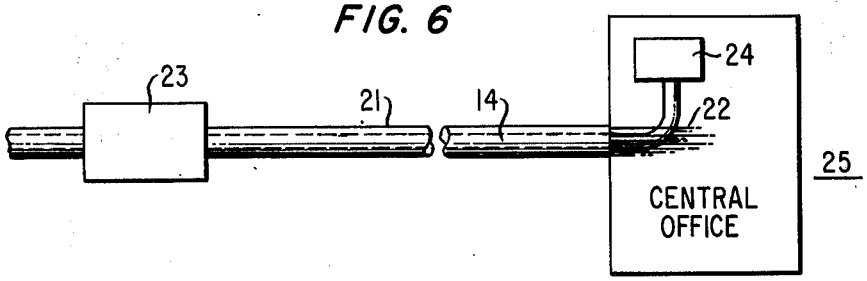
FIG. 6 is a schematic diagram of an installed H-screen.

FIG. 6 shows a cable 21 having a shield forming an interior corridor 14 pursuant to the present invention, installed in a communications system between a central office 25 and a repeater case 23 several hundred feet beyond the central office into the exchange area. Repeater case 23 requires air pressure to guard against intrusion of water thereinto. Pursuant to one aspect of the invention, such air pressure is provided through the corridor 14 of cable 21 from a pressure air source 24. The air reaches splice case 23 with relatively little pressure drop after the expansion has taken place.

Cables were constructed with the H-screen of the present invention separating two 25-pair count cable units on one side from two other 25-pair count units on the opposite side. Crosstalk measurements on combinations of pairs on opposite sides of the screen were made at 1.6 MHz. Unlike other cable screen configurations having an open side, the measurements on cable with H-screen show that the pairs having the relatively highest NEXT performance were distributed among the several units; and did not all occur in one unit. Such distribution is a statistically desirable condition in the outside cable plant. The H-screen configuration was also found to reduce greatly the transverse surface impedance. The double thick screening layer adds approximately 3 dB of additional screening improvement, while still affording a design that can be used in the core of a filled cable.

What is claimed is:

1. A mutipair communications cable comprising:

a core of insulated conductors;

a screen partitioning the core, comprising:

a first and a second metallic sheet, each being C-shaped in cross section and disposed in back-to-back relation; a jacket enveloping said core and screen; and means continuously joining the sheet backs along two separated paths parallel to the cable axis, creating an unjoined region between said paths.

2. The multipair cable of claim 1 further comprising electrical insulation sandwiched between the facing backs of said C-shaped sheets.

3. The multipair cable of claim 1 further comprising electrical insulating material enveloping each said C-shaped sheet.

4. The multipair cable of claim 1 wherein said joining means comprises a pair of continuous weldment lines.

5. The multipair cable of claim 1 wherein said joining means comprises adhesive bonding material.

6. A jacketed multipair communication cable comprising:

a core of insulated conductors;

a viscous fill substantially occupying the core space between said conductors; a metal screen partitioning said core into at least two separate sections, said screen comprising:

first and second metallic sheets disposed in back-to-back relation to form a central section;

two oppositely diverging sides extending from either edge of said central section and shaped to the contour of said cable jacket inner surface; and means continuously joining the sheet backs along two separated paths parallel to the cable axis.

7. A cable according to claim 6 wherein the unjoined region between said paths is expanded to form a longitudinal gas flow corridor within said core.

* * * * *